US006532599B1

(12) United States Patent
Dugan

(10) Patent No.: US 6,532,599 B1
(45) Date of Patent: Mar. 18, 2003

(54) ATHLETIC SHORTS WITH REMOVABLE CONTOURED PADS

(76) Inventor: Anthony J. Dugan, 609 N. Cherry St., Apt. #2, O'Fallon, IL (US) 62269

( * ) Notice: Subject to any disclaimer, the term of this patent is extended or adjusted under 35 U.S.C. 154(b) by 0 days.

(21) Appl. No.: 09/949,501

(22) Filed: Sep. 10, 2001

(51) Int. Cl.[7] ..... A41D 13/00
(52) U.S. Cl. ..... 2/228; 2/227
(58) Field of Search ..... 2/228, 238, 242, 2/23, 69, 44, 227, 268, 22, 267, 247, 465, 467, 455, 250, 252, 258, 260, 260.1, 79, 92, 403, 456, 404, 406, 400, 407, 401, 402, DIG. 3; 450/97, 98, 99, 100, 101, 94, 116, 150

(56) References Cited

U.S. PATENT DOCUMENTS 3,484,868 A * 12/1969 Davenport ..... 2/456
5,105,473 A * 4/1992 Valtakari ..... 2/456
5,134,726 A * 8/1992 Ross ..... 2/23
5,161,257 A * 11/1992 Arensdorf et al. ..... 2/456
5,168,576 A * 12/1992 Krent et al. ..... 2/456
5,365,610 A * 11/1994 Lubahn et al. ..... 2/23
5,539,926 A * 7/1996 Mantos ..... 2/23
5,551,082 A * 9/1996 Stewart et al. ..... 2/456
5,572,737 A * 11/1996 Valice ..... 2/465
5,649,328 A * 7/1997 Martin ..... 2/238
5,717,997 A * 2/1998 Garcia ..... 2/23
6,023,789 A * 2/2000 Wilson et al. ..... 2/228

* cited by examiner

*Primary Examiner*—John J. Calvert
*Assistant Examiner*—Tejash Patel
(74) *Attorney, Agent, or Firm*—Don W. Weber

(57) ABSTRACT

A pair of athletic shorts with removable contoured pads is presented. The elastic shorts have thigh, hip and tailbone pockets permanently affixed to the main shell of the shorts. Each of the pockets has upper flaps, which are fastened to the lower portion of the pocket by VELCRO™ fasteners. The pad itself is a semi-flexible cushioned type pad having a serrated configuration such that only portions of the pad actually come in contact with the athlete's body. These pads have peaks and valleys such that they are fully compressed only during a fall or a collision, remaining only in partial contact with the athlete's body at other times. The pads may be removed, washed, and replaced easily because they are not permanently sewn or attached to the main shell of the athletic shorts.

2 Claims, 3 Drawing Sheets

FIG. 3
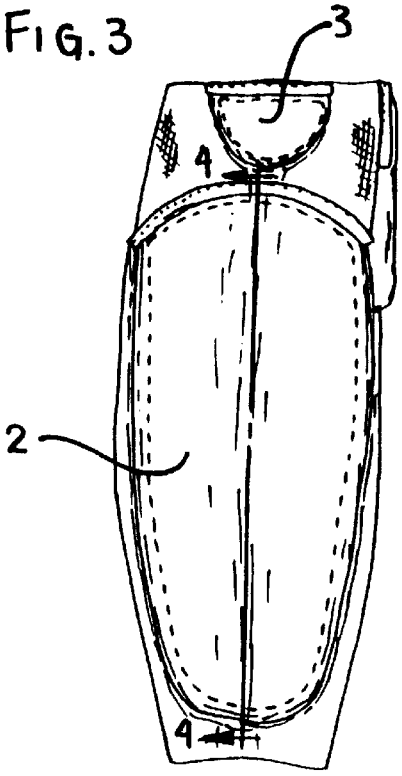
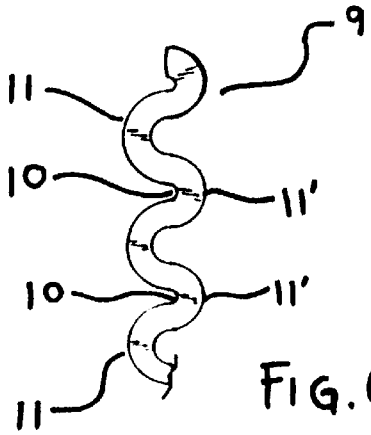
FIG. 6
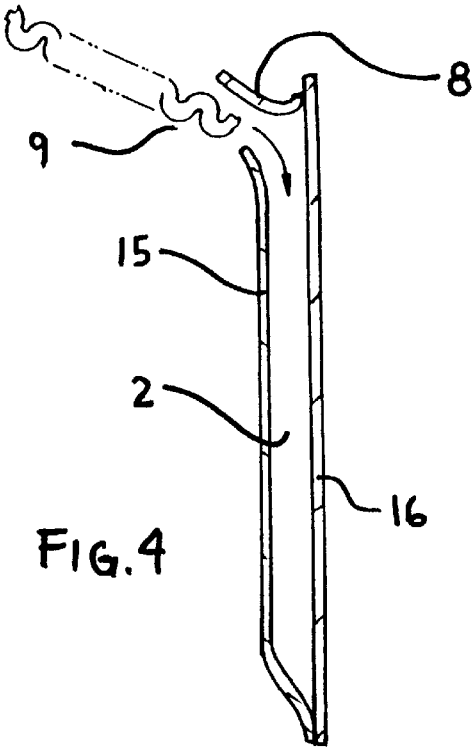
FIG. 4
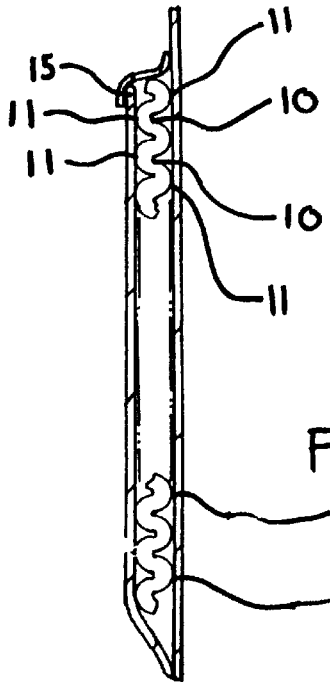
FIG. 5

ATHLETIC SHORTS WITH REMOVABLE CONTOURED PADS

BACKGROUND OF THE INVENTION

This invention relates to the field of athletic equipment. More particularly, an athletic short is provided which has removable, contoured pads to protect vital areas of the hips, thighs and tailbone.

In the field of athletic equipment, special clothing and padding is often utilized. For example, football players normally wear pads around their shoulders, hips and thighs in order to prevent serious injury upon falling. Other sports such as baseball, basketball and tennis also include padded apparel, which oftentimes provide various types of padding for the hips, thighs, tailbones, buttocks and other areas of the body.

One type of sports pants with pocketed pads is found in the 1994 patent issued to Lubahn. In this U.S. Pat. No. 5,365,610, a garment is provided to wear while playing sports. The garment has protective pads usually formed of foam, which are permanently affixed to pockets located strategically about the garment. Lubahn illustrates the use of pads to protect the thighs and portions of the hip (see FIGS. 1 and 5 of Lubahn). One drawback to having permanently affixed pads is that they are not removable for washing or replacement. It is an object of this invention to provide a padded sports garment which has removable and washable pads, which may be easily and readily reinserted into the garment once the pads have been cleaned.

Another type of padded skating shorts is found in U.S. Pat. No. 5,572,737 issued to Valice in 1996. The Valice invention embodies a padded core shell including pads for the ball joint, thigh, hip, tailbone, kidney and buttocks. These pads may be curved to somewhat simulate the actual contours of the body. As in the Lubahn patent, the Valice pads are sewn into the structure and are thus not removable. While Valice does approach the problem of conforming the pads to the contour of the athlete's body, a more comprehensive solution would improve upon the prior art. It is a further object of this invention to provide a removable and contoured pad capable of providing both safety and comfort to the wearer.

Other types of pads for various parts of the hips and legs are known in the art. However, it is an object of this invention to provide a new type of athletic short with removable and contoured pads such that the pads contact the body in the least amount of area and thus contour themselves to the athlete. Since the instant pads are removable and washable as well, a further object is to provide a padded athletic short with features that have heretofore been unknown in the art.

BRIEF DESCRIPTION OF THE INVENTION

A padded athletic short is provided having pockets around the thigh, hip, and talbone area of the body. The athletic shorts are made of an elastic material such as the trademarked material Spandex™ or Lycra™. Contoured and serrated pads are inserted into the respective pad pockets and removably secured in place by a pocket flap. The contoured pad tends to adapt its shape to the surface of the part to be protected (thigh, hip or talbone). The pads may be removed for washing and cleaning and may then be reinserted into the pocket using the flap closure.

BRIEF DESCRIPTION OF THE DRAWINGS

FIG. 3 is a side perspective view of the athletic shorts shown in FIGS. 1 and 2.

FIG. 4 is a detailed cutaway view of the thigh pocket taken along lines 4—4 of FIG. 3.

FIG. 5 is a side cutaway view of the thigh pocket shown in FIG. 3, taken along lines 4—4 shown with the pads inserted and the flap closed.

FIG. 6 is a partial side view of the actual pad, showing the contours of the pad.

DETAILED DESCRIPTION OF THE PREFERRED EMBODIMENT

Figure 1:
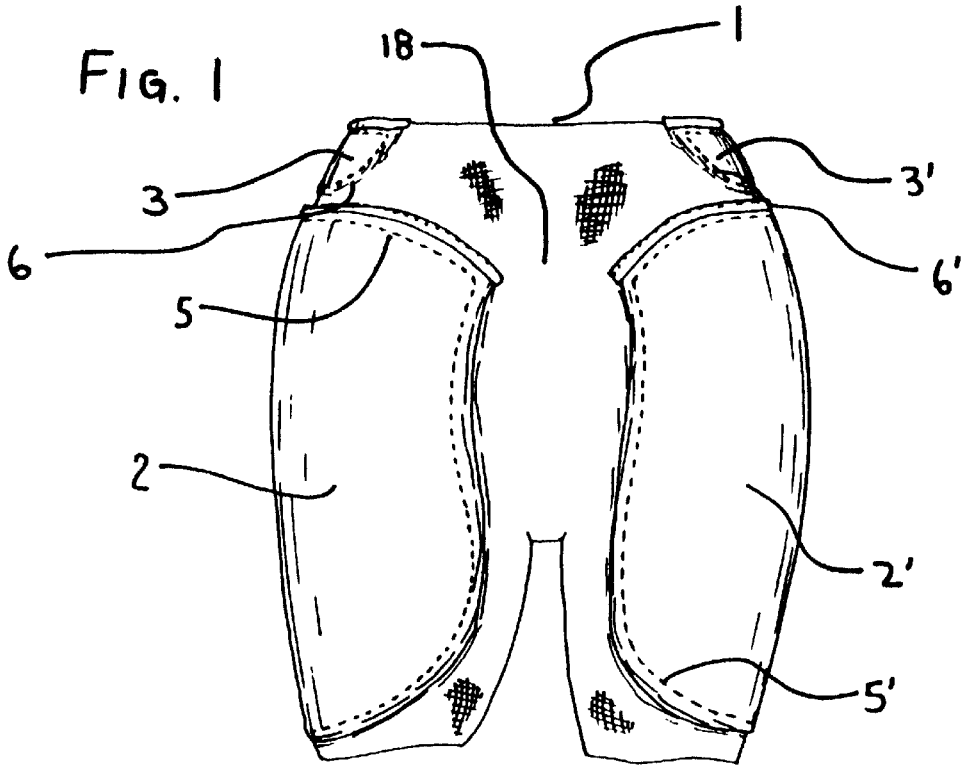
FIG. 1 is a front perspective view of the athletic shorts.
Figure 2:
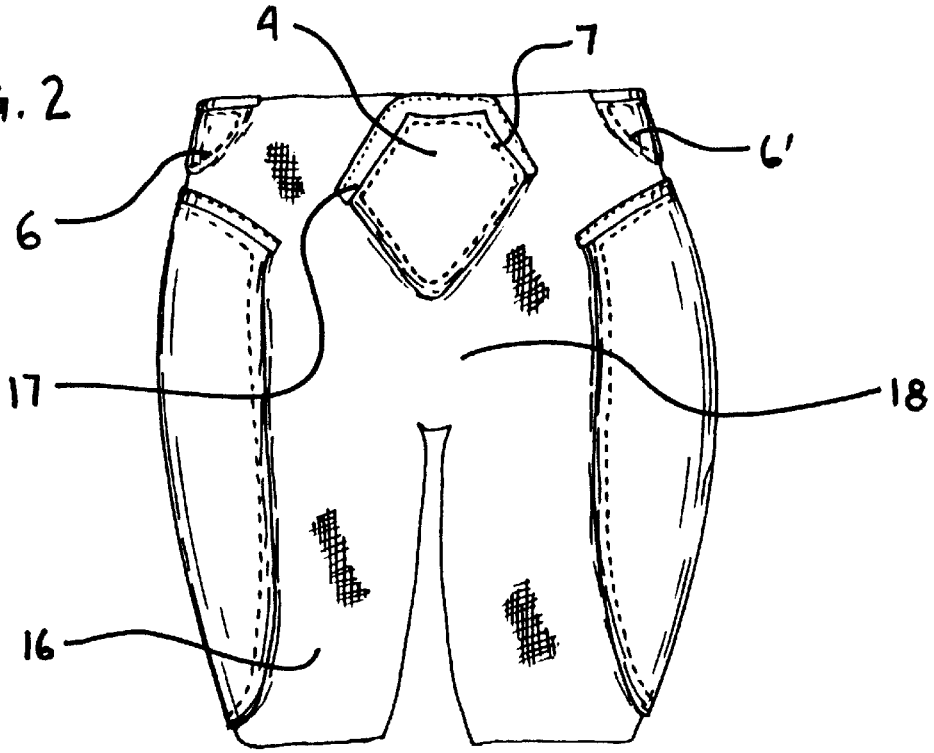
FIG. 2 is a rear perspective view of the athletic shorts.

A pair of athletic shorts 1 is shown in FIGS. 1 through 3. The shorts are made principally of an elastic and deformable material such as the trademarked material Spandex™, Lycra™ or other similar materials. The main shell of the athletic shorts 1 thus becomes form fitting when the athletic shorts are put on by the athlete. The shell 18, as well as the pockets, may be thin, solid and stretchable or may be made of a mesh type of material.

The athletic shorts 1 have a plurality of pockets adapted to receive contoured pads. Thin pockets are sewn into the left 2 and right 2' thigh areas. Left 3 and right 3' hip pockets are also sewn into the upper portion of the athletic shorts 1, as shown in FIGS. 1 and 2.

As best shown in FIG. 2, an irregularly, diamond-shaped tailbone pocket 4 is also sewn into the upper central rear portion of the athletic shorts 1. Although the tailbone pocket 4 may have the irregular shape as shown, its function and operation is similar to both the thigh 2 and hip 3 pockets shown in FIG. 1.

Each of the thigh 2, hip 3, and tailbone 4 pockets have an upper flap 8 attached to the main shell of the athletic shorts 1. As shown in FIG. 4, taken along lines 4—4 of FIG. 3 and shown in cross-section, the thigh pocket 2 has a lower outer side 15 connected at its lower end to the lower leg 16 of the athletic shorts. The thigh pocket 2 also includes an upper pocket flap 8. This upper pocket flap 8 has one edge attached to the main shell of the shorts and has its other end free.

A contoured pad 9 generally has the contoured shape as shown in FIGS. 4, 5 and 6. This contoured pad 9 is inserted into the thigh pocket 2 as shown in FIGS. 4 and 5. Once the pad 9 is inserted into the pocket, the upper flap 8 is secured to the lower outer side 15, as shown in FIG. 5. The preferred method of joining the free ends of the lower outer side 15 of the thigh pocket and the upper pocket flap 8 is by means of VELCRO™ hook-and-pile fasteners. While VELCRO™ fasteners are the preferred fastening means, other means such as buttons, zippers, or other detachable fasteners may be used while still keeping within the spirit and disclosure of this invention.

Due to the presence of the upper pocket flap 8 and fastening means, the contoured pads 9 may be readily removed. It is to be understood that the configuration of the upper flap 8 and the lower front side 15 of the thigh pocket and the upper main shell of the shorts 18 matches the configuration of the upper thigh pockets, the upper hip pad pockets and the upper tailbone pockets. While the configuration of the flap 8 is essentially an arc for the thigh pads, as best shown in FIG. 3, the upper flap for the hip pockets 3 and 3' and the tailbone pocket 4 matches the configuration of those pockets, respectively, but is slightly different in shape in order to conform the shape of the respective upper flap for the thigh, hip, and tailbone pockets to the configuration of the upper portion of those pockets. For example, the pocket flap 17 for the tailbone pocket 4 is irregularly shaped as best shown on FIG. 2.

Turning now to FIG. 6, the contour and general characteristics of the pads to be inserted into the pockets is shown. In the Drawing Figures, the dotted lines numbered 5, 5' 6 6' and 7 illustrate the location and shape of the thigh, hip or tailbone pads respectively. These pads are made of semi-resistant lightweight material such as is used to construct a molded grip for a baseball bat. The pad itself would be similar to covers used for soft drinks or other types of semi-deformable padding.

Each of the pads has a serrated cross section as shown in FIG. 6. This serrated cross section creates valleys 10 and peaks 11 in the general shape of the padding. An important advantage to the use of this type of padding is that only the peak 11 and 11' portions of the padding will normally be in contact with the athlete's body. For example, as shown particularly in FIG. 5, only the peaks 11 and 11' of the padding as shown will normally remain against the surface of the athlete's body. The other void spaces (or valleys 10) would not be in contact with the athlete's body. The pad is fully compressed only during collisions or falls. This has the advantage of further cushioning most of the area of the body to be protected from outside pressure and from the contact brought about by the elastic athletic shorts pressing the pads against the thigh, hip or tailbone.

Figure 7:
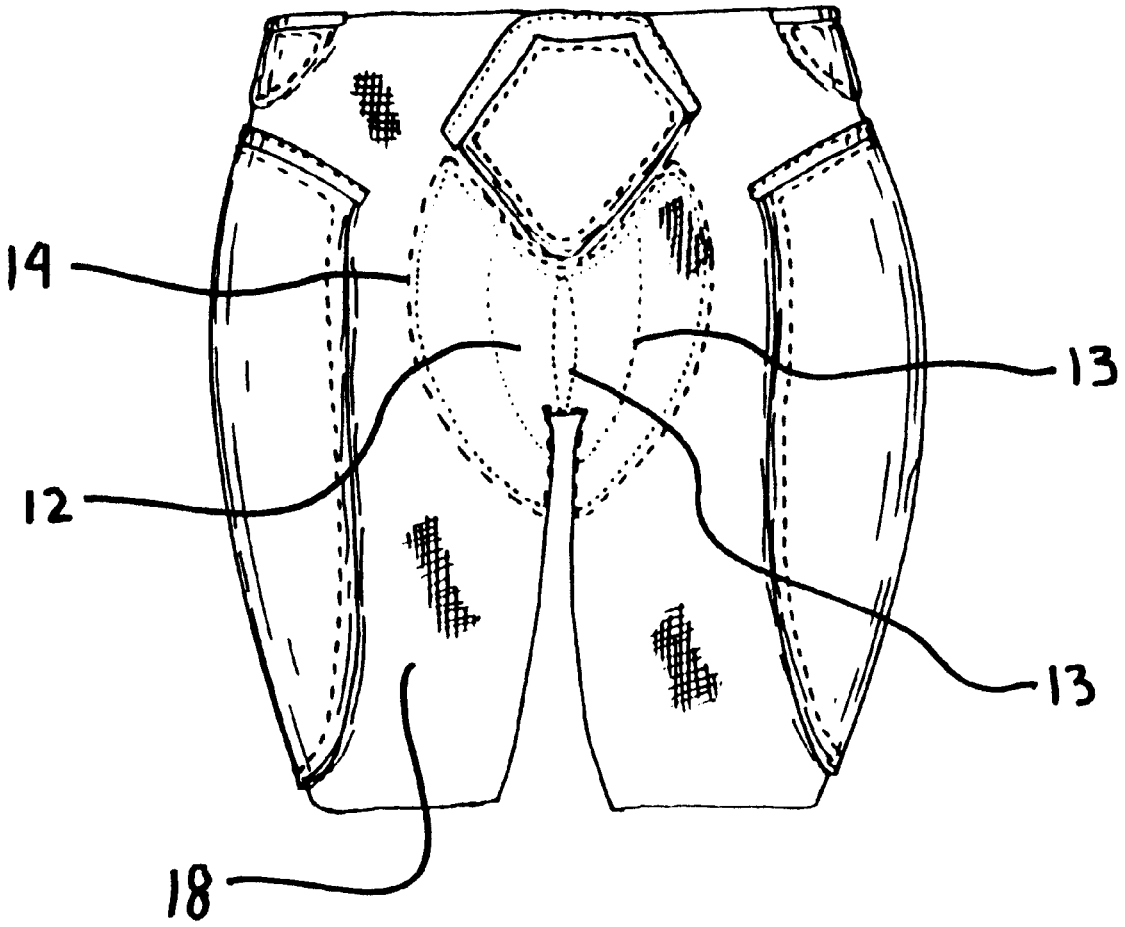
FIG. 7 is a rear perspective view of a second embodiment of the device, also including a thin buttock pad stitched permanently into the seat of the athletic shorts.

Turning now to FIG. 7, a further and additional embodiment of the athletic shorts is shown. This embodiment is quite similar to the embodiment shown and described in FIGS. 1 through 5, but also includes a lightweight buttock pad 12 similar to the type of padding found in athletic shorts used by bicyclists. This permanently stitched-in buttock pad 12 covers the area as shown in FIG. 7. The padding in this area is not as thick as for the thigh, hip or tailbone pads. However, this thin layer of padding, commonly comprised of several layers of white cloth or chamois type material is permanently affixed to the buttock area as shown in Drawing FIG. 7. This buttock pad has stitching 13 irregularly sewn in the buttock area as shown in FIG. 7. The outline of the perimeter 14 of the buttock pad 14 generally describes the area of the athletic shorts to which the buttock padding is added.

The body of the athletic shorts should generally be made of a breathable mesh material that is both elastic, flexible, and that will conform to the general shape of the wearer. The shell of the athletic shorts is of a lightweight material. The front side 15 of the pockets may also be made of a breathable mesh material. The pads themselves are bendable, flexible, and adapted to conform the shape of the pad to the contour of the athlete's body.

These particular shorts are designed specifically for use in athletic endeavors such as baseball, tennis, lacrosse, field hockey, and volleyball, as well as other sports. These athletic shorts could be utilized by the weekend athlete when exercising with rollerblades, bicycles, or other types of activities during which falls are sometimes encountered. The shorts protect the vital areas of the thighs, hips and tailbone from injury due to falls, collisions, or other types of physical contact.

The shorts themselves generally run from approximately the waist area of the athlete to the knee area of the athlete. However, utilization of further pockets to protect other parts of the body is also within the spirit and keeping of this invention. The advantageous aspects of this particular device, being the removable and washable pads as well as the contoured pads, provide a flexible yet effective means of protecting the athlete from injuries to vital areas of the body.

Having fully described my invention, I claim:

1. An athletic pants garment, comprising:

(a) a main shell of elastic shorts adapted to cover a person's body from the waist to the knees;

(b) a plurality of irregularly shaped pockets attached to the left and right hip area, the left and right thigh area and the tailbone area of said garment, wherein each of the plurality of pockets has an irregularly shaped opening adapted to receive a serrated, irregularly shaped pad;

(c) a plurality of irregularly shaped flaps attached to the main shell of said shorts wherein each of the plurality of pockets has a corresponding pocket flap and wherein each of the plurality of flaps is adapted to open and close the corresponding pocket;

(d) a plurality of removable and washable irregularly shaped bendable and flexible pads corresponding to said plurality of irregularly shaped pockets wherein the shape of each pad corresponds to the shape of each pocket, respectively;

and wherein each of the plurality of pads has a serrated cross-section along the length of the pad wherein said serrations create longitudinal peaks and valleys, wherein only the peak portions of the pads are in contact with the person's body except during compression occurring as a result of collisions or falls; and (e) a buttock pad permanently attached to the buttock area of said garment, wherein the padding of said buttock area is lighter than the plurality of removable hip, thigh and tailbone pads.

2. An athletic pant garment as in claim 1, wherein the plurality of pockets are made of a breathable, mesh material.

* * * * *